US008136601B2

(12) United States Patent
Tveiten et al.

(10) Patent No.: US 8,136,601 B2
(45) Date of Patent: Mar. 20, 2012

(54) POWER LIFT GENERATOR

(75) Inventors: Magnar Tveiten, Sandnes (NO); David Hutchinson, Kodal (NO); Egil Josefsen, Tananger (NO); Kristian Harestad, Randaberg (NO)

(73) Assignee: Petroleum Technology Company, Stavanger (NO)

( * ) Notice: Subject to any disclaimer, the term of this patent is extended or adjusted under 35 U.S.C. 154(b) by 145 days.

(21) Appl. No.: 12/532,635

(22) PCT Filed: Mar. 28, 2008

(86) PCT No.: PCT/NO2008/000117

§ 371 (c)(1),
(2), (4) Date: Nov. 24, 2009

(87) PCT Pub. No.: WO2008/120999

PCT Pub. Date: Oct. 9, 2008

(65) Prior Publication Data

US 2010/0059222 A1 Mar. 11, 2010

(30) Foreign Application Priority Data

Mar. 30, 2007 (NO) ..... 20071684

(51) Int. Cl.
*E21B 43/12* (2006.01)

(52) U.S. Cl. ..... 166/372; 166/169; 166/242.5

(58) Field of Classification Search ..... None
See application file for complete search history.

(56) References Cited

U.S. PATENT DOCUMENTS

| | | | | |
|---|---|---|---|---|
| 1,785,070 | A | 12/1930 | Bunch | |
| 3,301,806 | A | 1/1967 | Bruno | |
| 4,101,246 | A | 7/1978 | Erickson | |
| 6,568,478 | B2 | 5/2003 | De Almeida | |
| 2003/0141073 | A1 * | 7/2003 | Kelley | 166/372 |

FOREIGN PATENT DOCUMENTS

| | | |
|---|---|---|
| WO | WO 02/059485 | 8/2002 |
| WO | WO 2004/092537 | 10/2004 |

* cited by examiner

*Primary Examiner* — Zakiya W Bates
(74) *Attorney, Agent, or Firm* — Christian Abel

(57) ABSTRACT

A device for increasing the production flow in a production tubing, where the production tubing has at least one inlet or port for adding a fluid medium, adds the fluid medium through the at least one inlet or port at an angle α between 90 and 0 degrees with a longitudinal axis of the production tubing. The device further has elements that provide a rotation of the added fluid medium.

10 Claims, 6 Drawing Sheets

POWER LIFT GENERATOR

The present invention relates to a device for injecting gas into a production tubing of a subterranean well and a method for the same for enhancing the flow of a medium from a geological formation.

In producing hydrocarbons, including water, oil and oil with entrained gas, from a geological information, natural pressure in the reservoir acts to lift the produced medium upwards to the surface through a production tubing. The reservoir pressure must exceed the hydrostatic pressure of the fluid in the well bore and back-pressure imposed by the production facilities at the surface for the well to produce naturally. This is not always the case and one needs to assist the production flow to set it out of the production tubing.

The production may be enhanced by artificial supply of energy to the medium in the production tubing. The two most commonly used systems are water injection and gas injection. Other production enhancement methods exist through installation of subsea or sub surface electrically driven pumps or other elements to assist the production flow out of the production tubing. The basic idea for all such methods is to drive more hydrocarbons out of reservoir.

All artificial lift system known today releases a stream of medium into the production tubing, without controlling the stream's shape other than breaking the main injection stream into smaller streams and bubbles. Current release of stream medium like this can cause that the part of the stream medium will act against the production flow in the tube (i.e be added with a direction downwards in the production tubing) and thereby result in decreasing the production flow.

U.S. Pat. No. 1,785,670 describes a combined mixing and flow device, which may be positioned within a well to break up and agitate the liquid and impart a swirling motion thereto, to reduce slippage to a minimum and to assist the flow of liquid through the flow pipe or tube.

U.S. Pat. No. 4,101,246 describes a vortex jet pump, in which circumferential flow in a fluid flow passage through the pump is induced by a tangential power liquid jet inlet into the passage between its suction inlet and outlet. The pump, which has no moving parts, has a housing providing a fluid flow passage between a pumped fluid suction inlet and a pumped fluid outlet downstream therefrom. Downstream from the power liquid jet inlet there is a throat in the passage having a flow cross-section less than the flow cross-section of the passage adjacent the power liquid jet inlet. A diffuser section is provided in the passage downstream from the throat and includes means for converting primarily circumferential fluid flow to primarily axial fluid flow in the passage.

WO 02/059485 relates to a gas lift valve for use in an oil well, where the oil well produces by means of gas lift. The gas lift valve makes use of a central body venture for both controlling the flow of injection gas from an annulus between the tubing and the casing of the oil well, and precluding a reverse flow of fluids from the oil well to said annulus to occur.

WO 2004/092537 describes a mandrel for a gas lift valve which comprises an elongated body provided with means of connection at its ends. The body is provided with a side pocket and a side receptacle in the interior of which may be housed a gas lift valve which injects gas into the interior of the body of the mandrel for the gas lift valve by means of orifices positioned in a nose. The mandrel for the gas lift valve comprises additionally a lower body provided on the lower part of the valve receptacle of the mandrel of the side pocket, where the lower body is configured in a manner to seal the lower part of the valve receptacle to form a chamber and the lower body is provided with at least one injection orifice to inject gas into the interior of the body of the mandrel of the gas lift valve.

It is an aim with the present invention to provide a more efficient device and method to increase the production flow in a production tubing.

It is a further aim of the present invention to provide an improved method for increasing the production flow in a production tubing.

These objects are achieved with a device and a method according to the invention as defined in the enclosed independent claims, and embodiments of the invention are given in the dependent claims.

The present invention regards a device for increasing the production flow in a production tubing. The device comprises at least one inlet for adding a fluid medium and means to provide the added fluid at an angle $\alpha$ between 90 and zero degrees with the longitudinal axis of the tubing with an open end of the angle facing up-stream.

The angle 90 degrees is defined to be perpendicular to the production flow in the tubing and zero degrees is parallel with the production flow in the tubing with a direction upwards to the surface.

Preferably the added fluid is injected at an angle $\alpha$ between 90 and 0 degrees, more preferably between 88 and 2 degrees.

A production tubing in the present invention is either tubing within a casing positioned within a drilled well or a production riser between a sub sea installation and a production and or storing facility, where this facility can be a floating structure or a facility situated on the seabed or on land. It may also be a seabed pipeline leading to a processing plant.

With inlet in the present invention it should be understood an entering or a lead-in or an opening through the wall of the production tubing where through a flow of the fluid medium enters the production tubing. There may be, according to the invention, one or several inlets, where they may be arranged in different ways; if two inlets these may be opposite each other on two diametrical opposite positions in the tubing, there may be several inlets arranged evenly around the circumference of the tubing, or they may be staggered, symmetrical, or possibly in line to form a helix or a spiral and they may be arranged in several similar layers etc.

According to an aspect of the invention the device for increasing the production flow may comprise means to provide a rotation of the added fluid medium. There are two ways the added fluid medium may be rotated and one may use both or just one of this ways. A rotation of the added fluid medium around a central axis of the inlet may be achieved by forming an internal wall of the actual inlet with grooves, protrusions, ribs or other configurations to initiate a rotation of the added fluid around the axis of the inlet. By internal wall it should be understood an inside part of the inlet, this being either the hole/opening in the actual production tubing or a sleeve/pipe stub which is connected to the production tubing at the outside or inside of the production tubing.

Another possibility for achieving rotation around the centre axis of the inlet, is to form the internal wall of the inlet with a shape giving rotation to the added fluid medium, by giving the internal wall itself an angled form.

Rotation may also be achieved by giving the added fluid medium a tangential component in relation to a longitudinal axis of the production tubing through the inlet, the inlet may in this instance be formed in a way so that a inlet center axis do not cross a centre axis of the production tubing.

Positions of the device(s) and or inlet(s) is field and well specific and is usually determined before the well is brought on line; it will for instance be possible to arrange one or more devices at different heights of the production tubing if the density of the produced medium is high or if the pressure in the well is too low, in order to achieve the desired flow through the production tubing.

There may as said be several devices along the production tubing and these may be of similar or different configurations, depending on the needs in the field or well. In a possible embodiment of the device it comprises means for heating the added fluid medium before adding the fluid to the production tubing, where the heating can be done by direct heating, heat exchange, etc. This heating can either be done on an external facility or with the hydrocarbons in the well.

According to another aspect of the invention means for providing angling and or rotation of the added fluid may also comprise guiding means within the production tubing itself.

The rotation of the added fluid medium around the centre axis of the production tubing may be achieved or assisted by forming the internal wall of the production tubing with grooves, protrusions, ribs or other configurations, where these means furthermore may be angled with respect to an axis perpendicular to the production flow.

Another possibility to give the added fluid medium a rotation may be to extend the inlet so that it protrudes through the production tubing and a distance into the actual production flow.

Yet another possibility to give the added fluid medium a rotation, may be to insert a rotating element with grooves, protrusions, ribs or other configurations or a paddle-wheel inside the production tubing and in vicinity of the device.

Yet another possibility in order to increase the production flow may be to insert a rotating member between the casing and the production tubing, where the rotating member includes impeller blades. This will assist in adding rotation to the added fluid before it enters the production tubing. The impeller blades can further be placed on either inside or outside of the rotating member. The added fluid medium can be added in a area beneath the impeller blades, and forced upwards over the impeller blades thereby creating a swirling effect; an alternative way is to lead the added fluid medium direct on the impeller blades, where the energy that the added fluid has when it leaves the impeller blades (release energy) will be a part of the total rotational force that is generated. The impeller may thereby be passively or actively rotated, i.e rotated as a result of the fluid forced towards the impeller blades or alternatively by a motor arranged to rotate the impeller, or a combination. According to this embodiment the area above and below the rotating member is sealed off by a packer system, the system comprising safety valves.

Yet another possibility to give the added fluid medium a rotation, may be by narrowing a part of the production tubing. The narrowing may be done either by an "expanding element" (see FIG. 3 *c*), formed as a diverging pipe part or by an insertion part formed as a cone located coaxial to the production tubing axis. According to yet another aspect of the invention the device may comprise outside guiding means for guiding the fluid in the angled direction before entering the inlet and the production tubing. Outside guiding means may be a pipe running from a source of the added fluid medium to the inlet where the end of the pipe is having a partly U-shape configuration ending in the inlet.

The added fluid medium can be gas, liquid, processed well fluid or a part of the well fluid from the reservoir, where it can be taken at the position in vicinity of the device or added from an installation away from the device, for instance a floating production facility.

It is to be noticed that the device for increasing the production flow can be a separate, external unit and therefore also replaceable, which can be installed on the production tubing/seabed pipeline or it can be prefabricated in a pipe length. The installation or the prefabrication of the device is however not a part of the invention, and is therefore not discussed further.

The invention also regards a method for increasing the production flow in a production tubing. The method comprises adding the added fluid medium at an angle $\alpha$ into the production tubing through at least one inlet.

According to another aspect of the invention, the method comprises rotating the added fluid medium inside the production tubing.

The added fluid medium can be supplied into the production tubing in several ways, for instance through at least one pipe. The pipe can, in a way known to a skilled person, be connected to the devices and or inlets which are arranged on or round the production tubing. One alternative way to supply the added fluid medium to the production tubing is to use annulus.

The main feature of the device is therefore to control and increase well effluent production from reservoir by introducing the medium injection stream into the device where it creates an under-pressure within the inner tubing of the device, and as a result the device will establish a vacuum with suction into the reservoir. The device(s) can be placed from reservoir and up to end of process separation train, where the device(s) can be installed permanently or as a retrievable system. This can be done by letting the device be a part of the production tubing or it could comprise one or several separate elements which are lowered and installed along the production tubing.

Typically a production well, which will be planned for "Artificial Lift", will plan to install one or more side pocket mandrels or other communication ports to assist in the artificial lifting of the well by reducing the hydrostatic column weight. Other production string, such as concentric production string with a separate gas injection line can also be used, and as such, the layout of the production string is of no restriction to the device.

BRIEF DESCRIPTION OF THE DRAWINGS

The foregoing and other objects, features and advantages of the invention will be apparent from the following more particular description of preferred non-limiting embodiments of the invention, as illustrated in the accompanying drawings.

Figure 1:
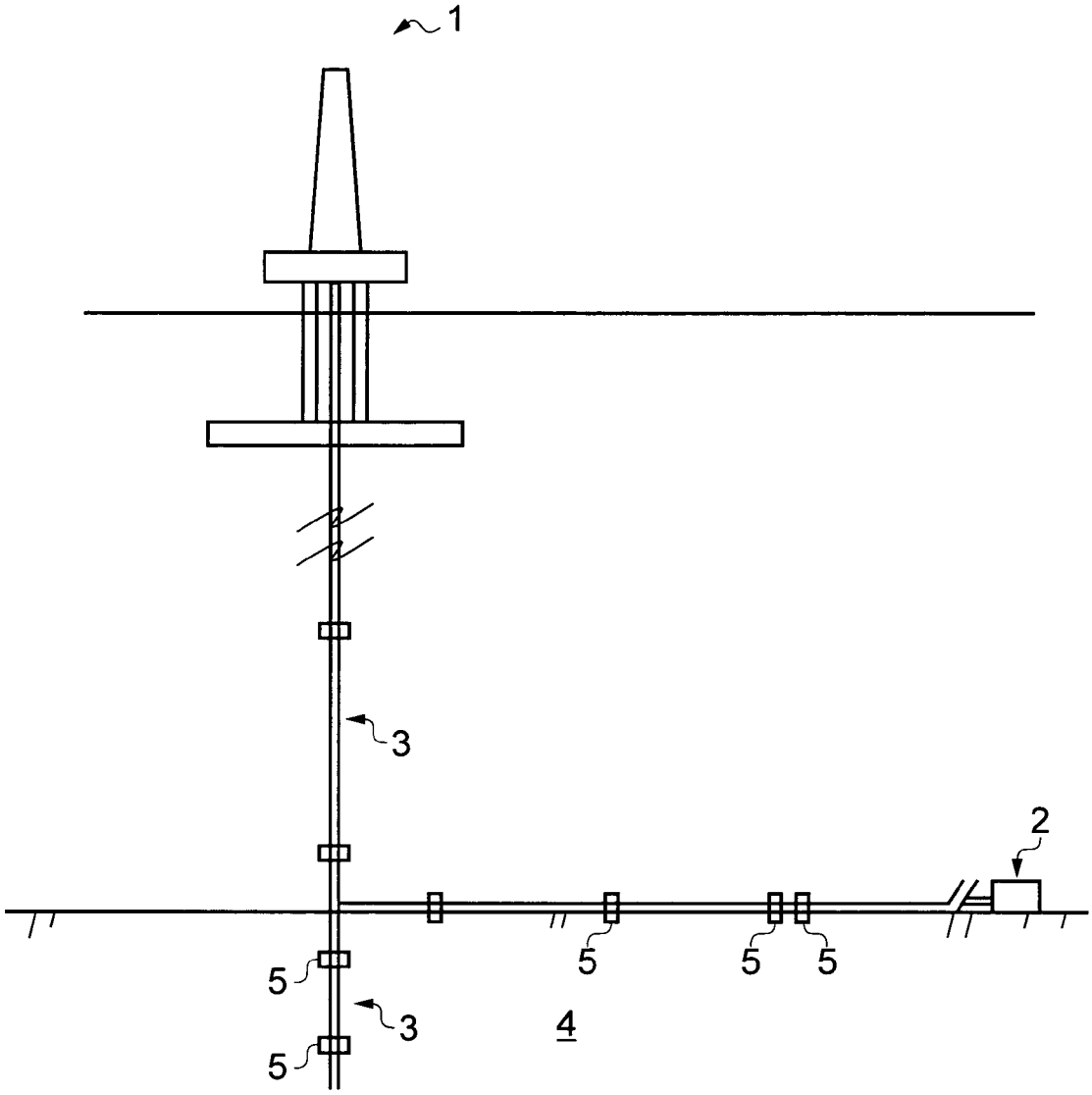
FIG. 1 is schematic view of the present invention

While the invention is subject of various modifications and alternative forms, specific embodiments have been shown by way of example in the drawings and will be described in detail herein. The drawings are further not necessarily in scale and the proportions of certain parts have been exaggerated to better illustrate particular details of the present invention.

In the description which follows, like part are marked throughout the specification and drawings with the same reference numerals, respectively.

DETAILED DESCRIPTION OF THE PREFERRED EMBODIMENTS

Referring now to FIG. 1, an embodiment of the invention is showed, where an oil well 4 is connected to a floating structure 1 or a seabed—2 or land-based structure (not shown) by a production tubing 3, where these structures can be production and or storing facilities.

In order to enhance the production of the well 4, a fluid medium is injected into the production tubing 3. This is done by placing one or more devices 5 along the production tubing 3, through which devices 5 the added medium 1 is injected.

The added fluid medium can be gas, liquid, processed well fluid or even a part of the well fluid from the reservoir and can be taken at the position in vicinity of the device 5 (that is from the well) or added from an installation 1, 2 away from the device 5.

How many devices 5 should be placed along the riser or tubing 3 and which features they should possess, will depend on the needs in the field or well.

Figure 2:
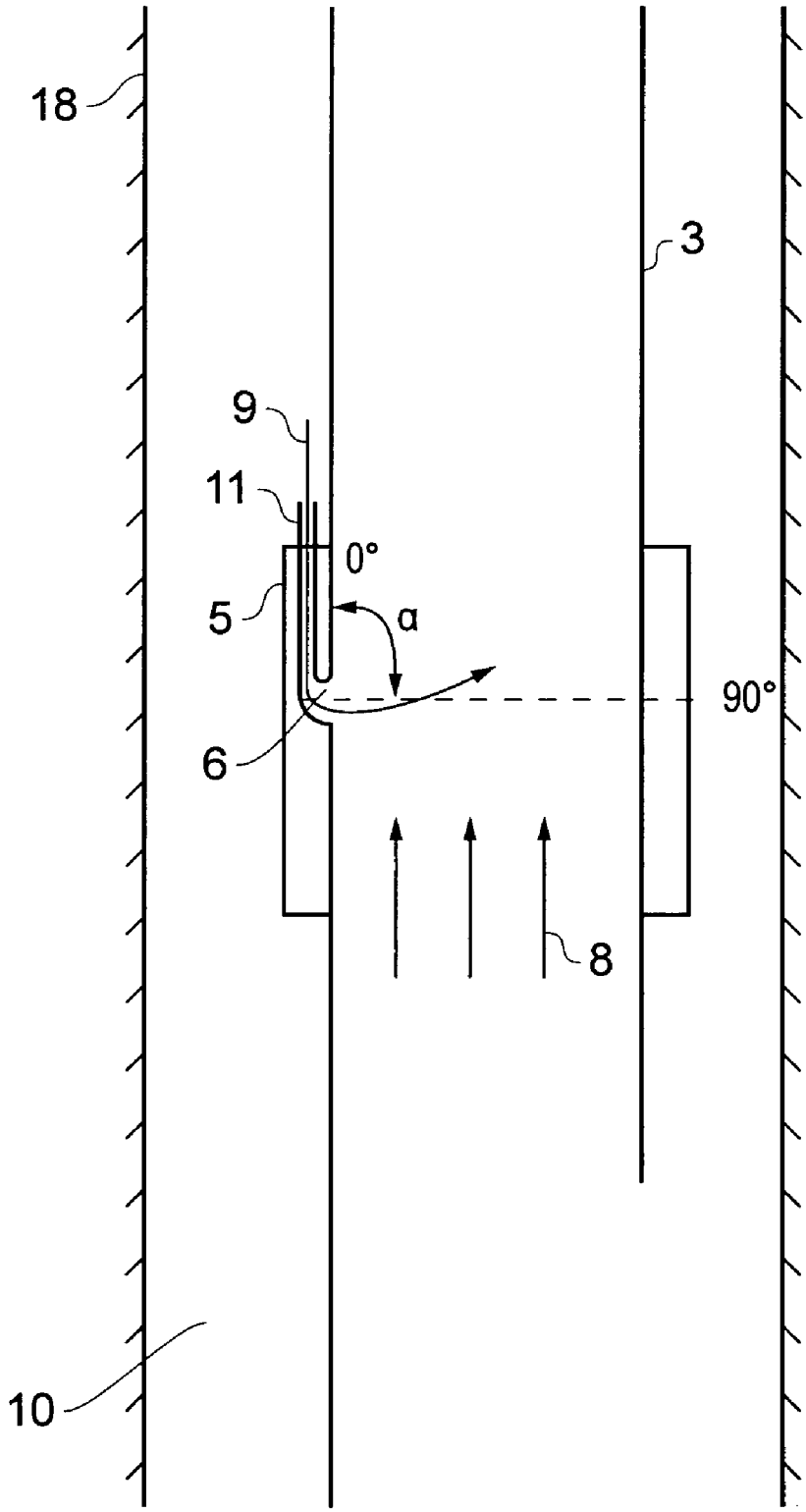
FIG. 2 is a cross-sectional illustration of the inlet along the longitudinal direction of the production tubing FIG. 3 A-J shows alternative embodiments for angling and or rotating the injection fluid through the inlet and into the production tubing.

In FIG. 2 a cross-section taken along the longitudinal axis of the production tubing 3 with installed device 5 with an inlet 6 is shown. In this particular embodiment the device is prefabricated in the pipe length. The added fluid medium is supplied from one or more pipes 11 and through one or more inlet(s) 6, at which the fluid is angled. Instead of using pipes, the medium can also be delivered through an annular space 10 between the casing and the production tubing. The angle 90 degrees is defined to be perpendicular to the fluid flow 8 which is mainly parallel with a longitudinal axis of the production tubing while 0 degrees is parallel with the production flow in the tubing 3 with a direction upwards to the surface. The angle $\alpha$ indicates the angle at which the added fluid is injected into the production tubing, and preferably this angle is between 88 and 2 degrees.

In order to enhance the production flow 8 further, the device can comprise means (not shown) for heating the added fluid/medium before the fluid is injected to the production tubing. These may for instance be arranged within the device 5.

Figure 3A:
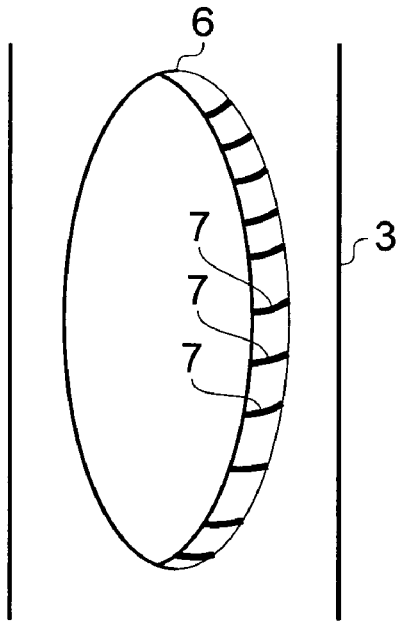
Figure 3B:
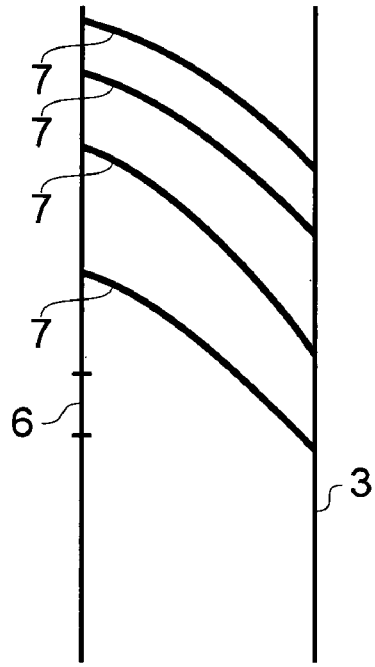
Figure 3C:
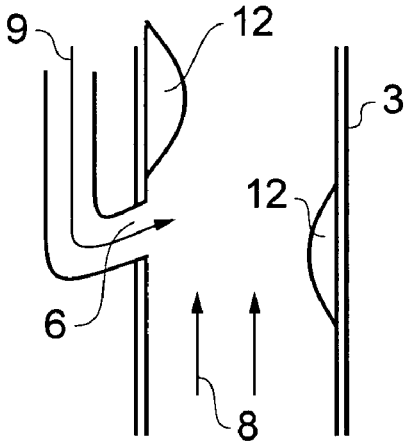
Figure 3D:
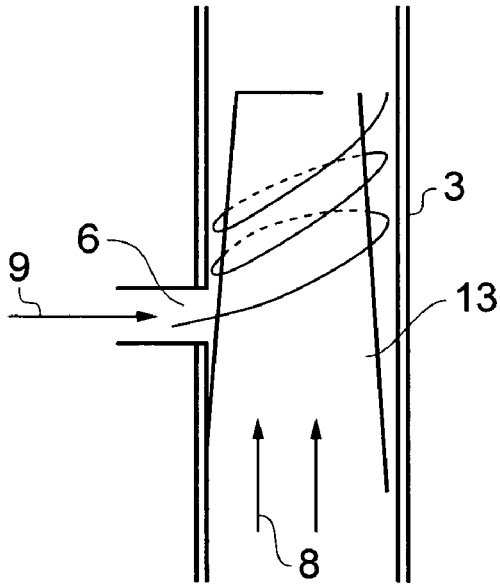
Figure 3F:
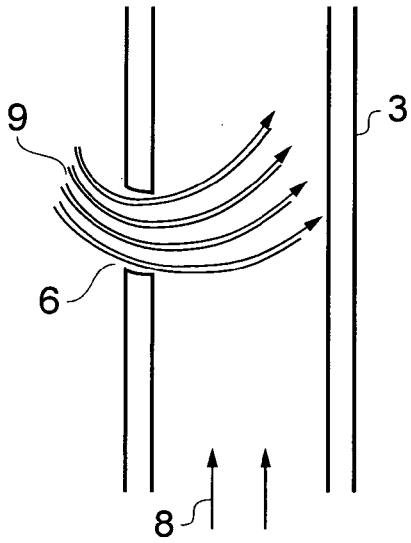
Figure 3E:
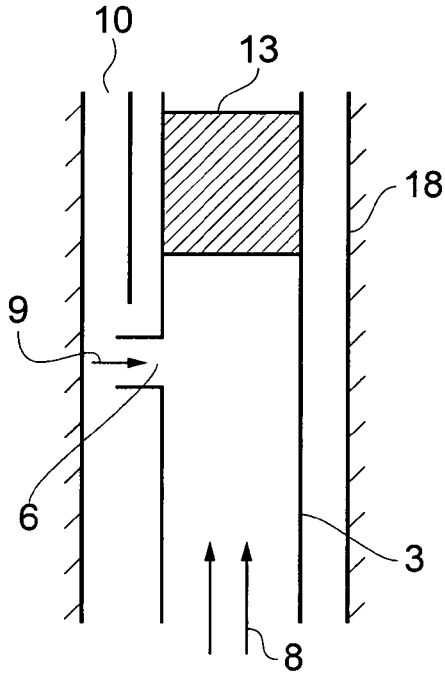
Figure 3G:
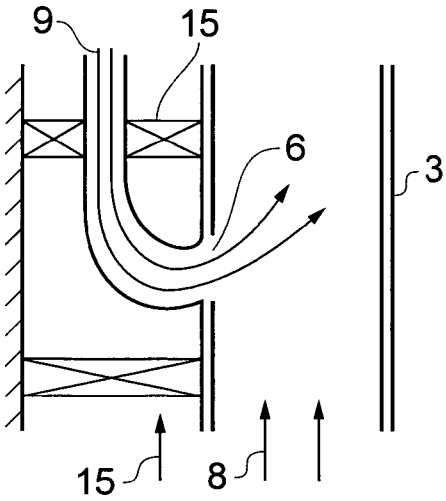
Figure 3H:
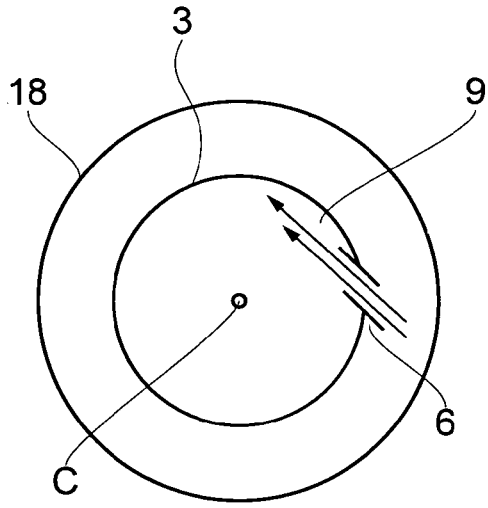

There are several embodiments to enhance the production flow 8 according to the invention, where some of them are shown in FIG. 3; this can be achieved by arranging grooves, ribs, protrusions 7 etc. on an inlet 6 internal wall or on a inside of the production tubing 3 as shown in FIGS. 3A-B, by expanded elements 12 or inserted elements 13 in the production tubing 3 as shown in FIGS. 3C-E or by shaping the inlet 6 portion as shown in FIGS. 3F-H.

In FIG. 3A the rotation or swirling of the added fluid medium can be achieved by shaping or forming the internal wall of inlet 6 with grooves, protrusions or ribs 7. The shape of inlet 6 itself could also be designed to give the added fluid medium a tangential component through the inlet 6 by having the centre axis of the inlet 6 not crossing a centre axis of the production tubing 3, see also FIG. 3H.

Alternatively, as shown in FIG. 3B, rotation may also be achieved by having a production tubing 3, comprising ribs or vanes 7 which are angled in relation to a possibly angling of the inlet 6 in the FIG. 2. The ribs or vanes 7 can be formed as continuing or broken threads. Materials, thickness and profile of the ribs or vanes 7 will also be of importance when the swirling or rotation of the added fluid medium is decided.

The desired effect of the rotation could also be achieved by combining two or more of the features discussed in a device 5. This can be seen in the FIG. 3C, where the rotation or the swirling of the added fluid medium is obtained by narrowing a part of the production tubing and angling of the inlet 6. One or more expanding elements 12 are placed inside the production tubing to cooperate with the inlet 6.

In FIG. 3D an inserted, rotating element 13 formed as a truncated cone within the production tubing 3 where the inlets 6 are facing the axis of the cone 13 and the production flow 8 is guided through the cone 13 will provide the wanted rotation of the fluid medium; the inserted element 13 can furthermore be allowed to rotate and or to be designed with ribs or vanes 7.

As can be seen in FIG. 3E, instead of forming the internal wall of the production tubing 3 with protrusions, ribs or grooves 7, a rotating element 13 can be inserted into the production tubing 3, in order to give the added fluid medium a rotation or swirl; the rotating element 13 may be fixed to the production tubing 3 or it can rotate.

FIGS. 3F-H show further embodiments of the invention, where the wall of the inlets 6 is formed/shaped in such a way that the desired swirling or rotation of the added fluid medium can be obtained. The added fluid medium can be added through the space 10 between the casing 18 and the production tubing 3 (see also FIG. 3E), or by sealing off a space with packers 15 above and below inlet(s) 6 and supplying the added fluid medium through one or more pipes 11 In FIG. 3H the rotation of the production flow 8 is gained by giving the added fluid medium 9 a tangential component in relation to a longitudinal axis of the production tubing through the inlet 6. The inlet 6 may in this embodiment be formed in a way so that an inlet 6 center axis do not cross a centre axis C of the production tubing 3.

FIGS. 3 I-J are alternative embodiments of the invention, where the device 5 comprises a rotating member 13 provided with impeller blades. The rotating member 13 is allowed to rotate or rotated relative the production tubing 3, thereby adding a rotational force to the added fluid medium before it is added through the inlets 6 into the production tubing 3. A packer system 15 is sealing off the area between the casing 18 and the production tubing 3 above and below the device 5 thereby forming an annular chamber 17. Further, the rotating member 13 is anchored to the packers 15, for instance by means of roller bearings 16, thus allowing the rotating member 13 to rotate. Since one would like to add the added fluid with a positive angle relative the flow direction 8 of the fluid within the production tubing 3. The added fluid is transferred from the surface to the annular chamber 17 and in the bottom of this annular chamber 17 the flow direction of the added fluid is turned to be directed in the same direction as the flow within the production tubing 3, i.e. the annular chamber is divided in at least two compartments both having a flow of added fluid but in opposite directions. This division of the annular chamber 17 may be formed by the rotating member 13 or by a divisional wall of the rotating member 13 and is acting on the added fluid in the compartment where the added fluid is flowing in the same main direction as the flow through the production tubing 3. In order to be able to shut-off the production tubing, for instance in connection with installation of the packer system and or with unwanted situations, there are above and over the packer system 15 installed safety valves (not shown in any figures), where these are controlled from an external facility.

Figure 3I:
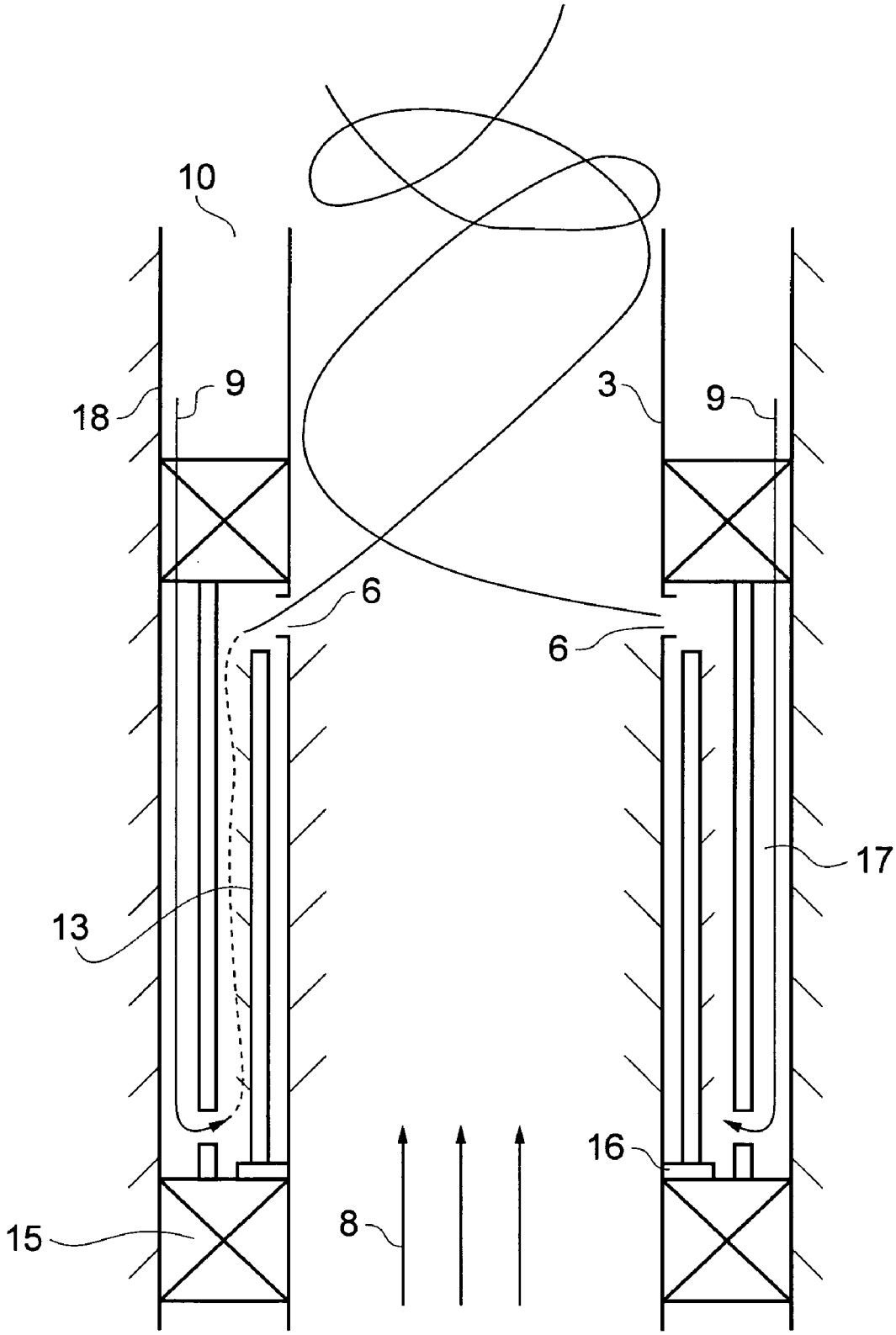

In one embodiment shown in the FIG. 3I the rotating member 13 has the impeller blades shaped on both its inside and outside i.e. there is another divisional annular shaped wall. In order to obtain a rotation of the rotating member 13, and thereby also the desired effect of the swirling, added fluid medium, the added fluid medium is injected into the compartment with the rotational member 13, guided through this compartment and thereby given a swirling effect before it is injected into the production tubing 3 through one or more inlets 6. This injection of the added fluid medium to the compartment 17 will drive the rotating member 13 to rotate and due to the shape of the impeller blades, the injected fluid medium will be forced to rise whereby it is discharged to the production tubing 3 through one or more inlets 6 along the rotating member 13. At the same time, the blades on the impellers inside will, because of the rotation of the rotating member 13, begin to create a rotation of the flow 8 in the production tubing 3. Further, if the rotation speed exceed a certain value, the blades on the impellers inside will form an under pressure in the production tubing 3, thereby increasing the swirling effect further. The inlets 6 can further be closable.

Figure 3J:
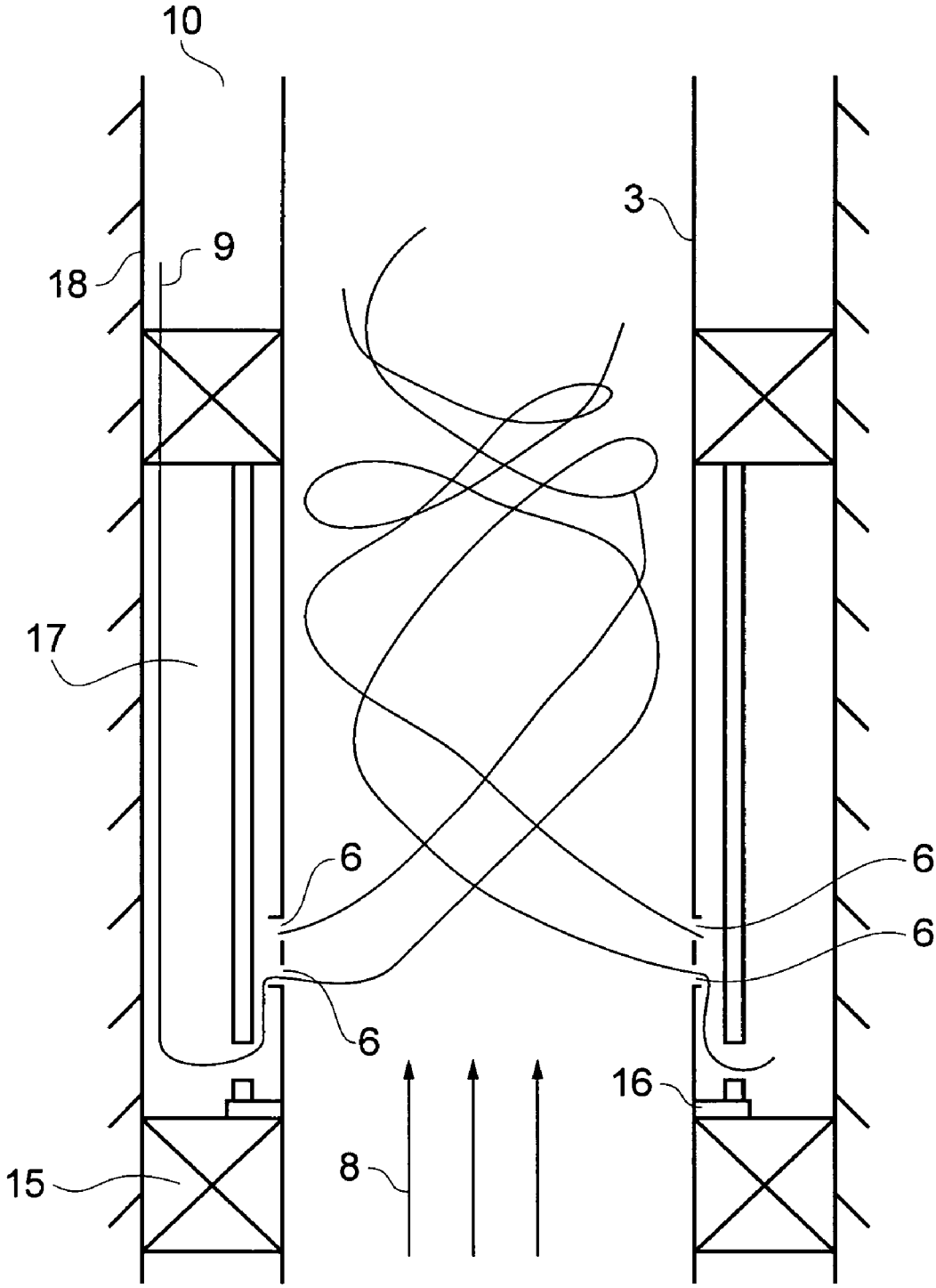

In the other embodiment shown in the FIG. 3J, the rotating member 13 has the impeller blades shaped on its inside. Correspondingly as above, the added fluid medium is injected into the compartment 17 comprising the rotating member 13, near the lower part of the rotating member 13. The lower part of the rotating member 13 is further designed as a distribution chamber (openings and leading means) for the added fluid medium, in order to create an exact direction for the added fluid medium. When the added fluid medium is released inside the production tubing 3 through one or more layers of inlets 6, the rotating member 13 will have, by its rotation, created a swirling effect in the added fluid medium.

One should understand that the added fluid medium is supplied to the production tubing 3 by way of pipes 11 and or through the space 10 between the casing 18 and the production tubing 3. How this is done will be evidently for a skilled person and is therefore not discussed further.

While the structures and methods of the present invention have been described in terms of preferred embodiments, it will be apparent to those skilled in the art that variations may be applied to what has been described herein without departing from the concept, script and scope of the invention. All such similar substitutes and modifications apparent to those skilled in the art are deemed to be within the spirit, scope and concept of the invention as it is set out in the following claims.

The invention claimed is:

1. Device for increasing the production flow in a production tubing, where the production tubing comprises at least one inlet or port for adding a fluid medium, the fluid medium being added through the at least one inlet at an angle $\alpha$ between 90 and 0 degrees with a longitudinal axis of the production tubing, with an open end of the angle facing upstream, wherein the device further comprises a rotating member provided with impeller blades arranged in an annular chamber between a casing and the production tubing, the annular chamber being formed by a packer system, the annular chamber further being divided in at least two compartments both having a flow of added fluid but in opposite directions, such that the flow direction of the fluid medium is turned in the bottom of the annular chamber, the fluid medium being provided with a rotation relative the production tubing before it is injected into the production tubing through the at least one inlet.

2. Device according to claim 1, wherein the impeller blades are provided on at least one side of the rotating member.

3. Device according to claim 1, wherein the rotation of the added fluid is provided by rotating the added fluid around an axis of the inlet.

4. Device according to claim 1, wherein the rotation of the added fluid is provided by adding the fluid at a tangential angle.

5. Device according to claim 1, wherein rotation of the added fluid is provided by at least one guide member within the production tubing.

6. Device according to claim 1, wherein the at least one inlet or port comprises an opening in the production tubing, the shape of which imparts the rotation of the added fluid.

7. Device according to claim 1, further comprising outside guiding means for guiding the added fluid in the angled direction before entering the production tubing.

8. Device according to claim 1, further comprising a pipe running from a source of the added fluid to the at least one inlet, where the packer system seals off the area between the production tubing and an outer casing above and below the at least one inlet and an end of the pipe having a partly U-shape ending in the inlet.

9. Device according to any one of the preceding claims 1-8, wherein the device is arranged as a separate external unit or a prefabricated pipe length.

10. Method for increasing the production flow in a production tubing, comprising adding a rotating fluid medium to the production flow at an angle through at least one inlet or port, wherein a rotating member with impeller blades is arranged in an annular chamber between a casing and the production tubing, the annular chamber being formed by a packer system, the annular chamber further being divided in at least two compartments both having a flow of added fluid but in opposite directions, such that the flow direction of the fluid medium is turned in the bottom of the annular chamber, to provide a rotation in the added fluid medium relative the production tubing before it is injected into the production tubing through the at least one inlet.

* * * * *